US009074810B2

(12) United States Patent
Hwang et al.

(10) Patent No.: US 9,074,810 B2
(45) Date of Patent: Jul. 7, 2015

(54) REFRIGERATOR

(75) Inventors: Jungyeon Hwang, Gyeongsangnam-do (KR); Jinwon Kang, Gyeongsangnam-do (KR); Myungdong You, Gyeongsangnam-do (KR); Woonkyu Seo, Gyeongsangnam-do (KR); Hanjin Jung, Gyeongsangnam-do (KR); Eunjoo Lee, Gyeongsangnam-do (KR); Hangbok Lee, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 211 days.

(21) Appl. No.: 13/642,149

(22) PCT Filed: Apr. 21, 2011

(86) PCT No.: PCT/KR2011/002905

§ 371 (c)(1),
(2), (4) Date: Apr. 29, 2013

(87) PCT Pub. No.: WO2011/132974

PCT Pub. Date: Oct. 27, 2011

(65) Prior Publication Data

US 2013/0257255 A1 Oct. 3, 2013

(30) Foreign Application Priority Data

Apr. 21, 2010 (KR) ..... 10-2010-0036722
Apr. 30, 2010 (KR) ..... 10-2010-0040647
Apr. 7, 2011 (KR) ..... 10-2011-0032225

(51) Int. Cl.
*F25D 23/04* (2006.01)
*F25D 23/02* (2006.01)
*F25D 25/02* (2006.01)

(52) U.S. Cl.
CPC ..... *F25D 23/04* (2013.01); *F25D 23/02* (2013.01); *F25D 25/025* (2013.01); *F25D 2400/06* (2013.01)

(58) Field of Classification Search
CPC ... F25D 23/021; F25D 23/028; F25D 25/025; F25D 23/02; F25D 23/04; F25D 2400/006; A47B 88/0485; A47B 88/0411; A47B 96/16
USPC ..... 312/401–402, 404–405.1, 408, 273; 62/377, 382
See application file for complete search history.

(56) References Cited

U.S. PATENT DOCUMENTS 2,726,914 A * 12/1955 Allen ..... 312/405
2,903,315 A * 9/1959 Schory et al. ..... 312/405.1

(Continued)

FOREIGN PATENT DOCUMENTS

CN 2458575 Y 11/2001
CN 1646867 A 7/2005

(Continued)

OTHER PUBLICATIONS

International Search Report dated Dec. 23, 2011 for Application No. PCT/KR2011/002905, 2 pages.

(Continued)

*Primary Examiner* — Daniel J Troy
*Assistant Examiner* — Ryan A Doyle
(74) *Attorney, Agent, or Firm* — Fish & Richardson P.C.

(57) ABSTRACT

Provided is a refrigerator including a pantry part in a refrigerator compartment. Since the pantry part can slide forward, and then, rotate, an object can be conveniently put in or taken out from the refrigerator.

12 Claims, 13 Drawing Sheets

(56) References Cited

U.S. PATENT DOCUMENTS

| | | | | |
|---|---|---|---|---|
| 2,926,507 | A * | 3/1960 | Ingolia | 62/377 |
| 3,195,969 | A * | 7/1965 | Wallen | 312/269 |
| 6,253,568 | B1 * | 7/2001 | Peffley | 62/441 |
| 7,467,834 | B2 | 12/2008 | Kim | |
| 2004/0183415 | A1 | 9/2004 | Kim | |
| 2005/0127804 | A1 | 6/2005 | Kim | |
| 2005/0258961 | A1 | 11/2005 | Kimball et al. | |
| 2006/0043853 | A1 * | 3/2006 | Chung | 312/405 |
| 2006/0080994 | A1 | 4/2006 | Seiden et al. | |
| 2007/0018548 | A1 * | 1/2007 | Ertz et al. | 312/402 |
| 2007/0035222 | A1 * | 2/2007 | Lee et al. | 312/405 |
| 2007/0132348 | A1 | 6/2007 | Kim | |
| 2007/0182295 | A1 | 8/2007 | Kim | |
| 2008/0047282 | A1 | 2/2008 | Bodin et al. | |
| 2009/0133434 | A1 * | 5/2009 | Uihlein et al. | 62/449 |
| 2009/0277210 | A1 | 11/2009 | Eveland et al. | |

FOREIGN PATENT DOCUMENTS

| | | | |
|---|---|---|---|
| DE | 102004045476 | A1 | 3/2006 |
| DE | 102008010061 | A1 | 9/2009 |
| JP | H 09-113111 | A | 5/1997 |
| KR | 2003-0088658 | A | 11/2003 |
| WO | WO 2006/032641 | A1 | 3/2006 |
| WO | WO 2009/026950 | A1 | 3/2009 |

OTHER PUBLICATIONS

Chinese Office Action and Search Report dated Jun. 25, 2014 for Chinese Application No. 201180030079.7 with English Translation, 9 pages.

* cited by examiner

REFRIGERATOR

CROSS REFERENCE TO RELATED APPLICATIONS

This application is a U.S. National Phase Application under 35 U.S.C. §371 of International Application PCT/KR2011/002905, filed on Apr. 21, 2011, which claims the benefit of Korean Application No. 10-2010-0036722, filed on Apr. 21, 2010, Korean Application No. 10-2010-0040647, filed on Apr. 30, 2010, and Korean Application No. 10-2011-0032225, filed on Apr. 7, 2011, the entire contents of which are hereby incorporated by reference in their entireties.

TECHNICAL FIELD

The present disclosure relates to a refrigerator.

BACKGROUND ART

Refrigerators are electric appliances for storing foods at low temperature.

Such a refrigerator uses a refrigerating cycle including a compressor, a condenser, an expansion device, and an evaporator, and supplies cool air generated by the evaporator, to a food storing space.

Refrigerators may be classified into top mount type refrigerators, side-by-side type refrigerators, and bottom freezer type refrigerators, according to positions of a refrigerator compartment and a freezer compartment. In top mount type refrigerators, a freezer compartment is disposed over a refrigerator compartment. In side-by-side type refrigerators, a freezer compartment and a refrigerator compartment are disposed on the left and right sides, respectively. In bottom freezer type refrigerators, a freezer compartment is disposed under a refrigerator compartment.

Recently, bottom freezer type refrigerators are widely used in which a refrigerator compartment is opened and closed by a pair of rotary doors, and a freezer compartment is opened and closed by a drawer-type door. In addition, a refrigerator door may include a dispenser for dispensing water or ice, and a home bar through which a food can be taken out from a refrigerator compartment without opening the refrigerator door. Moreover, freezer compartments may include a separate switching room.

DISCLOSURE OF INVENTION

Technical Problem

Embodiments provide a refrigerator including a storage structure to conveniently put an object therein or take out an object therefrom.

Solution to Problem

In one embodiment, a refrigerator includes: a main body defining a storage space for a food; a pantry assembly disposed in the storage space and storing a food, wherein the pantry assembly includes: a first pantry part sliding in the storage space; and a second pantry part disposed in front of the first pantry part and sliding together with the first pantry part, wherein the second pantry part is allowed to rotate when at least one portion of the second pantry part has been pulled out from the storage space.

In another embodiment, a refrigerator includes: a main body defining a storage space for a food; and a pantry assembly disposed in the storage space, wherein the pantry assembly includes: a first pantry part sliding in the storage space; and a second pantry part sliding in the storage space, wherein the second pantry part is allowed to rotate when at least one portion of the second pantry part has been pulled out from the storage space; and a pantry door coupled to a front surface of the second pantry part.

In another embodiment, a refrigerator includes: a main body defining a storage space; a pantry assembly that is pushed in and pulled out from the main body, wherein the pantry assembly includes: a first pantry part moving back and forth in the storage space; a second pantry part disposed in front of the first pantry part, wherein the second pantry part is allowed to rotate when at least one portion of the second pantry part has been pulled out from the storage space; and an installation member on which the first pantry part and the second pantry part are installed, the installation member sliding in and out of the storage space.

The details of one or more embodiments are set forth in the accompanying drawings and the description below. Other features will be apparent from the description and drawings, and from the claims.

Advantageous Effects of Invention

According to the embodiments, the following effects can be attained.

After opening a refrigerator door, a user can store an object or take out it from a refrigerator compartment without putting a part of his/her body into the refrigerator compartment. That is, a user can take out an object from a second pantry part and put an object into the second pantry part, without putting his/her hand in the refrigerator compartment or bending his/her body.

An object can be taken out from a first pantry part without putting a hand deep into a refrigerator compartment, so that a user can conveniently use a refrigerator. In detail, when a pantry door is closed, an object is stored deep in the first pantry part, and thus, is effectively cooled. When the pantry door is pulled out, the first pantry part moves forward up to the front surface of the refrigerator compartment. Thus, a user can more conveniently put an object in the first pantry part or take out an object from the first pantry part.

In the case of a typical refrigerator, an object is stored in the rear portion of a refrigerator compartment first to more efficiently store objects. However, an object can be stored in the front portion of a basket first since a second pantry part according to an embodiment can be rotated 90 degrees outside a refrigerator.

When a pantry assembly is pulled out, the first pantry part moves forward up to the front surface of the refrigerator compartment. Thus, a user can more conveniently put an object in the first pantry part or take out an object from the first pantry part.

When a drawer-type pantry door moves, a pantry basket fixed to the rear surface of the pantry door, and a moving basket accommodated in a pantry room can be pulled out. Since the pantry door and the moving basket can be simultaneously or sequentially pulled out, a user can more conveniently use the refrigerator.

MODE FOR THE INVENTION

Reference will now be made in detail to the embodiments of the present disclosure, examples of which are illustrated in the accompanying drawings. The spirit and scope of the present disclosure, however, shall not be construed as being limited to embodiments provided herein. Rather, it will be apparent that other embodiments that fall within the spirit and scope of the present disclosure may easily be derived through adding, modifying, and deleting elements herein.

Figure 1:
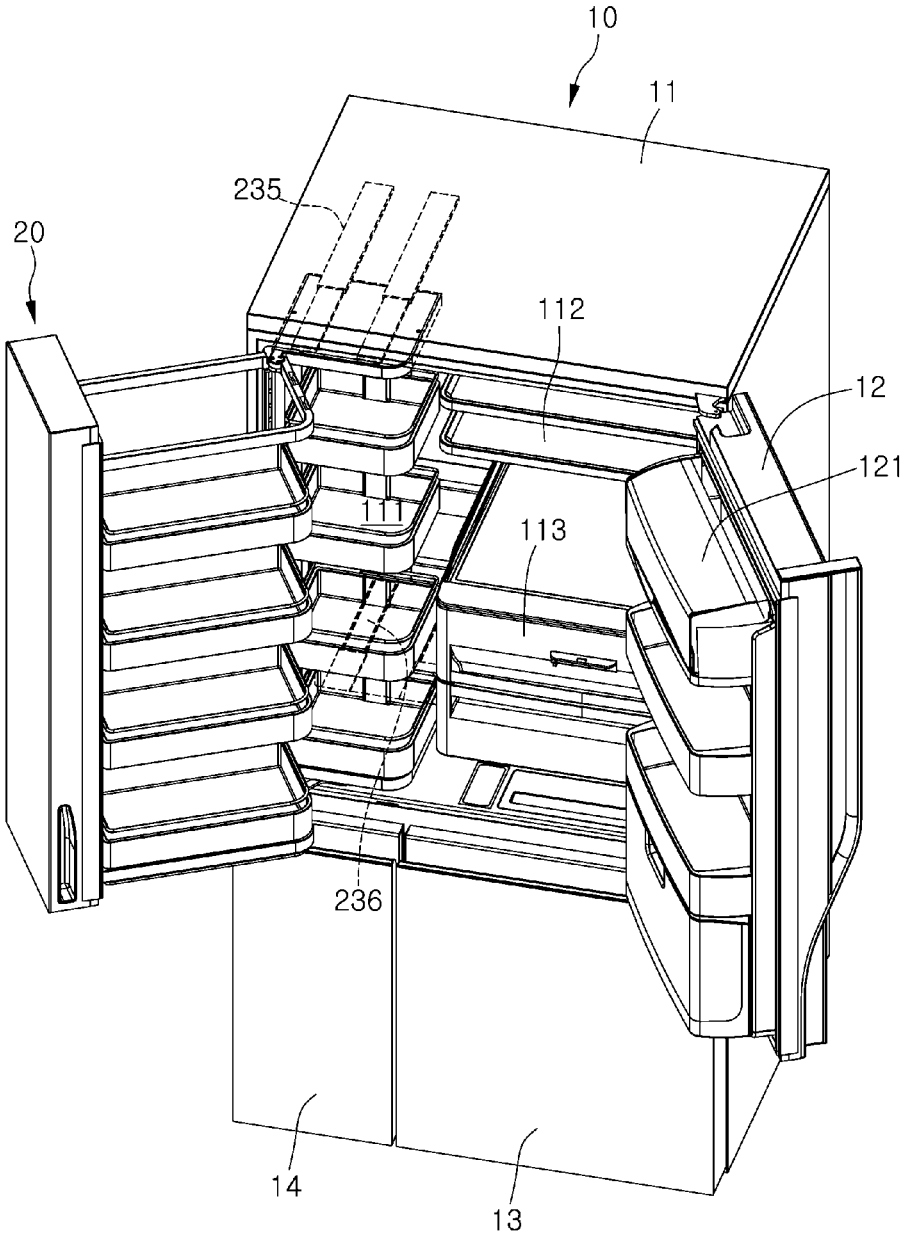
FIG. 1 is a perspective view illustrating an inner structure of a refrigerator according to an embodiment.
Figure 2:
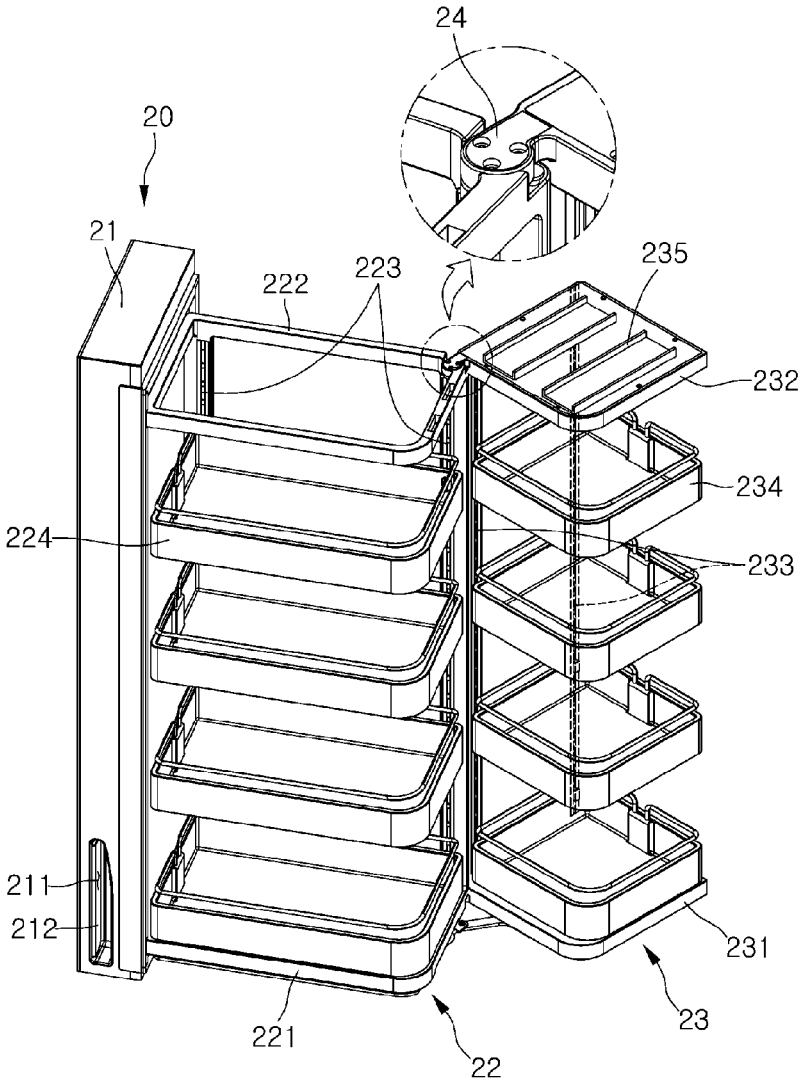
FIG. 2 is a perspective view illustrating a pantry assembly for a refrigerator compartment according to an embodiment.
Figure 3:
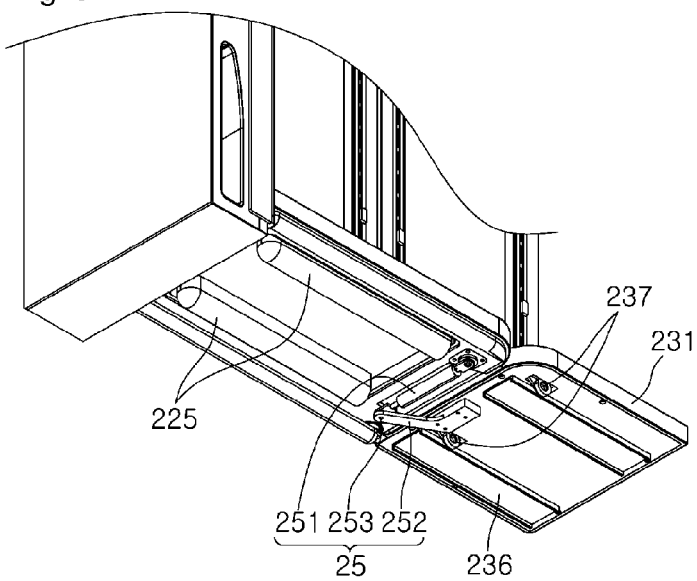
FIG. 3 is a perspective view illustrating a bottom portion of the pantry assembly of FIG. 2.

FIG. 1 is a perspective view illustrating an inner structure of a refrigerator according to an embodiment. FIG. 2 is a perspective view illustrating a pantry assembly for a refrigerator compartment according to an embodiment. FIG. 3 is a perspective view illustrating a bottom portion of the pantry assembly of FIG. 2.

Referring to FIGS. 1 to 3, a refrigerator 10 according to an embodiment may include: a main body 11 including a refrigerator compartment 111 and a freezer compartment (not shown) therein; a refrigerator door 12 for selectively opening and closing the refrigerator compartment 111; a pantry assembly 20 that is pushed in and pulled out from the refrigerator compartment 111; a freezer door 13 for selectively opening and closing the freezer compartment; and a drawer-type pantry assembly that is pushed in and pulled out from the freezer compartment. The freezer door 13, which stands upright, moves back and forth to open and close at leant one portion of the freezer compartment.

The drawer-type pantry assembly includes the freezer door 13 that is a drawer-type one, and a storage box (not shown) that is disposed on a rear surface of the freezer door 13 to move together with the freezer door 13. As described above, the freezer door 13, which stands upright, moves back and forth to open and close at leant one portion of the freezer compartment.

The drawer-type pantry assembly to be described later may be disposed in the freezer compartment. In detail, the drawer-type pantry assembly may be disposed in a pantry room that is separately disposed in a side portion of the freezer compartment, or may take one portion of the freezer compartment.

The refrigerator door 12 is rotatably coupled to an edge of the main body 11 defining the refrigerator compartment 111. A plurality of door baskets 121 may be installed on the rear surface of the refrigerator door 12. A dispenser 122 may be installed on the front surface of the refrigerator door 12 to dispense water or ice.

A plurality of shelves 112 and a plurality of drawers 113 may be disposed in the refrigerator compartment 111 behind the refrigerator door 12, and may have a width corresponding to that of the refrigerator door 12. Thus, the refrigerator door 12 is closed to cover the shelves 112 and the drawers 113 from the front side, and is opened to push in and pull out the shelves 112 and the drawers 113.

The pantry assembly 20 is disposed in the refrigerator compartment 111. In detail, the pantry assembly 20 includes a pantry door 21 for opening and closing one portion of the refrigerator compartment 111, a second pantry part 22 disposed on the rear surface of the pantry door 21 and moving together with the pantry door 21, and a first pantry part 23 rotatably connected to the second pantry part 22.

In detail, a handle recess 211 may be disposed in a side surface of the pantry door 21. A lever 212 is disposed in the handle recess 211 to facilitate a removal of the pantry door 21 from the main body 11. In general, a gasket including a magnet is disposed around the rear surface of a refrigerator door. A front edge of the main body 11 may be formed of a metal conductor, so that the refrigerator door can closely contact the main body 11 by magnetic force of the magnet. Due to the magnetic force and the weight of the refrigerator door, it may be difficult for children and the elderly to open the refrigerator door. The lever 212 is used to remove the magnet of the gasket from the main body 11 just before opening the pantry door 21. That is, when the lever 212 is pressed in a direction of opening the pantry door 21, a protrusion member (not shown) protrudes from an edge of the rear surface of the pantry door 21, so that the pantry door 21 can be removed from the main body 11.

The second pantry part 22 includes a lower plate 221 extending horizontally from the lower end of the rear surface of the pantry door 21, an upper frame 222 extending horizontally from the upper end of the rear surface of the pantry door 21, one or more edge frames 223 connecting corners of the lower plate 221 to corners of the upper frame 222, and a plurality of baskets 224 spaced a distance from one another between the lower plate 221 and the upper frame 222.

The lower plate 221 has an approximately tetragonal shape, and may include a sliding guide part 225 on the bottom surface thereof. The basket 224 may be placed on the top surface of the lower plate 221. In detail, the sliding guide part 225 contacts the bottom surface of the refrigerator compartment 111 while the second pantry part 22 is pushed in or pulled out of the refrigerator compartment 111. In this state, the pantry assembly 20 is pulled out. The bottom surface of the second pantry part 22 is in line contact with the bottom surface of the refrigerator compartment 111 through the sliding guide part 225, thereby reducing frictional force therebetween. A plurality of rollers may replace the sliding guide part 225.

The edge frames 223 vertically extend to connect the corners of the upper frame 222 to the corners of the lower plate 221. The edge frames 223 have a plurality of coupling holes in which hook parts protruding from the corners of the baskets 224 can be fitted. In the current embodiment, the number of the edge frames 223 disposed at the corners of the lower plate 221 and the upper frame 222 is two, but the present invention is not limited thereto, and thus, the number of the edge frames 223 may be three or four.

The first pantry part 23 includes a lower plate 231 extending horizontally at the lower end of the rear surface of the pantry door 21, an upper plate 232 extending horizontally at the upper end of the rear surface of the pantry door 21, one or more edge frames 233 connecting corners of the lower plate 231 to corners of the upper plate 232, and a plurality of baskets 234 disposed between the lower plate 231 and the upper plate 232.

The edge frames 233 may be the same in shape and function as the edge frames 223 of the second pantry part 22.

A first rail part 235 may be installed on the top surface of the upper plate 232, and a second rail part 236 may be installed on the bottom surface of the lower plate 231. In detail, stationary rails (refer to FIG. 1), which are coupled to the first rail part 235, are installed on a ceiling surface of the refrigerator compartment 111, so that the first pantry part 23 can move back and forth in the refrigerator compartment 111. Stationary rails, which are coupled to the second rail part 236, are installed on the bottom surface of the refrigerator compartment 111. A rail member and one or more rollers 237 are installed on the bottom surface of the lower plate 231 to facilitate a back-and-forth movement of the pantry assembly 20. Although not shown, rail parts may be installed on both the bottom surface of the first pantry part 23 and a side surface of the refrigerator compartment 111. That is, the rail part may be installed on at least one of a side surface of the refrigerator compartment 111 and the top surface and the bottom surface of the first pantry part 23.

The second pantry part 22 may be rotatably connected to the first pantry part 23 through a hinge part 24. In detail, the hinge part 24 may extend from both ends of one of the second pantry part 22 and the first pantry part 23, and be rotatably connected to an end of the other thereof. In FIG. 2, the first pantry part 23 is rotatably connected to the corner of the upper frame 222 where the hinge part 24 extends from the corner of the upper plate 232 of the first pantry part 23 and joins the edge frame 223. However, the present invention is not limited thereto, and thus, the second pantry part 22 may be rotatably connected to the first pantry part 23 according to various methods. Any method may be used to connect the second pantry part 22 to the first pantry part 23, provided that the second pantry part 22 can be rotated.

A damping unit 25 is installed on both the bottom surface of the first pantry part 23 and the bottom surface of the second pantry part 22 to damp down shock generated when the second pantry part 22 rotates from the first pantry part 23. For example, when the second pantry part 22 rotates away from the first pantry part 23, the damping unit 25 decelerates a rotation speed of the second pantry part 22 to prevent a collision between the second pantry part 22 and furniture adjacent to the refrigerator 10. On the contrary, when the second pantry part 22 rotates to the first pantry part 23, the damping unit 25 decelerates a rotation speed of the second pantry part 22 to prevent a collision between the second pantry part 22 and the first pantry part 23.

In detail, the damping unit 25 includes a support arm 252 fixed to the bottom surface of the lower plate 231 of the first pantry part 23, and a damper 251 fixed to the bottom surface of the second pantry part 22. The support arm 252 extends a predetermined length to the front side of the lower plate 231, and an end of the damper 251 is rotatably connected to an end of the support arm 252. That is, a connector 253 is disposed at the end of the support arm 252. The other end of the damper 251 is fixed to the bottom surface of the lower plate 221.

Accordingly, when the second pantry part 22 rotates away from the first pantry part 23, the damper 251 rotates about the connector 253. When the damper 251 rotates, a damping cylinder is pushed in or pulled out of the damper 251 to decelerate a quick rotation of the second pantry part 22. The damper 251 and the support arm 252 may change positions with each other. That is, the damper 251 may be installed on the bottom surface of the first pantry part 23, and the support arm 252 may be installed on the second pantry part 22.

Hereinafter, an operation of the pantry assembly 20 will now be described.

Figure 4:
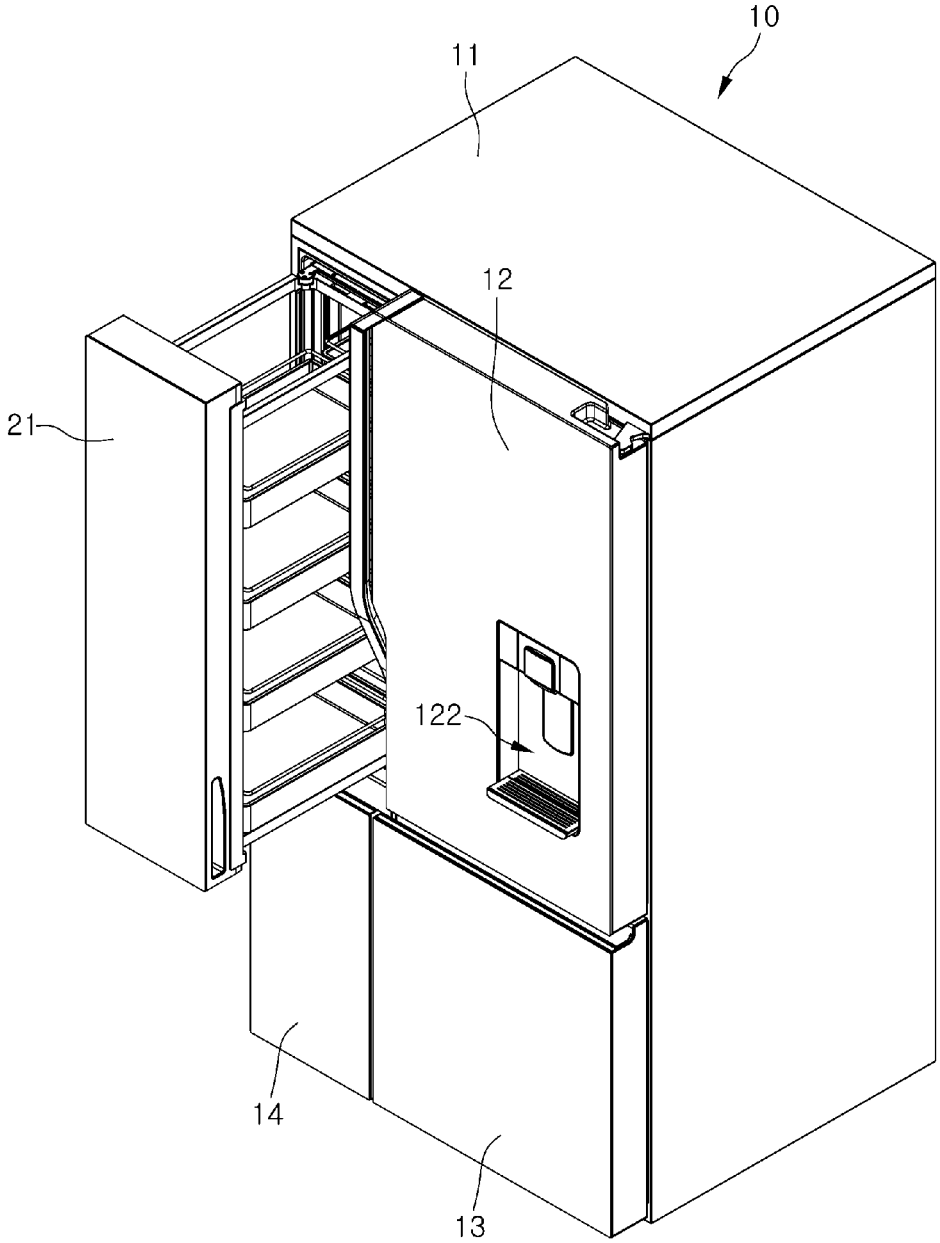
FIG. 4 is a perspective view illustrating a state in which a second pantry part constituting a pantry assembly is pulled out of a refrigerator according to an embodiment.
Figure 5:
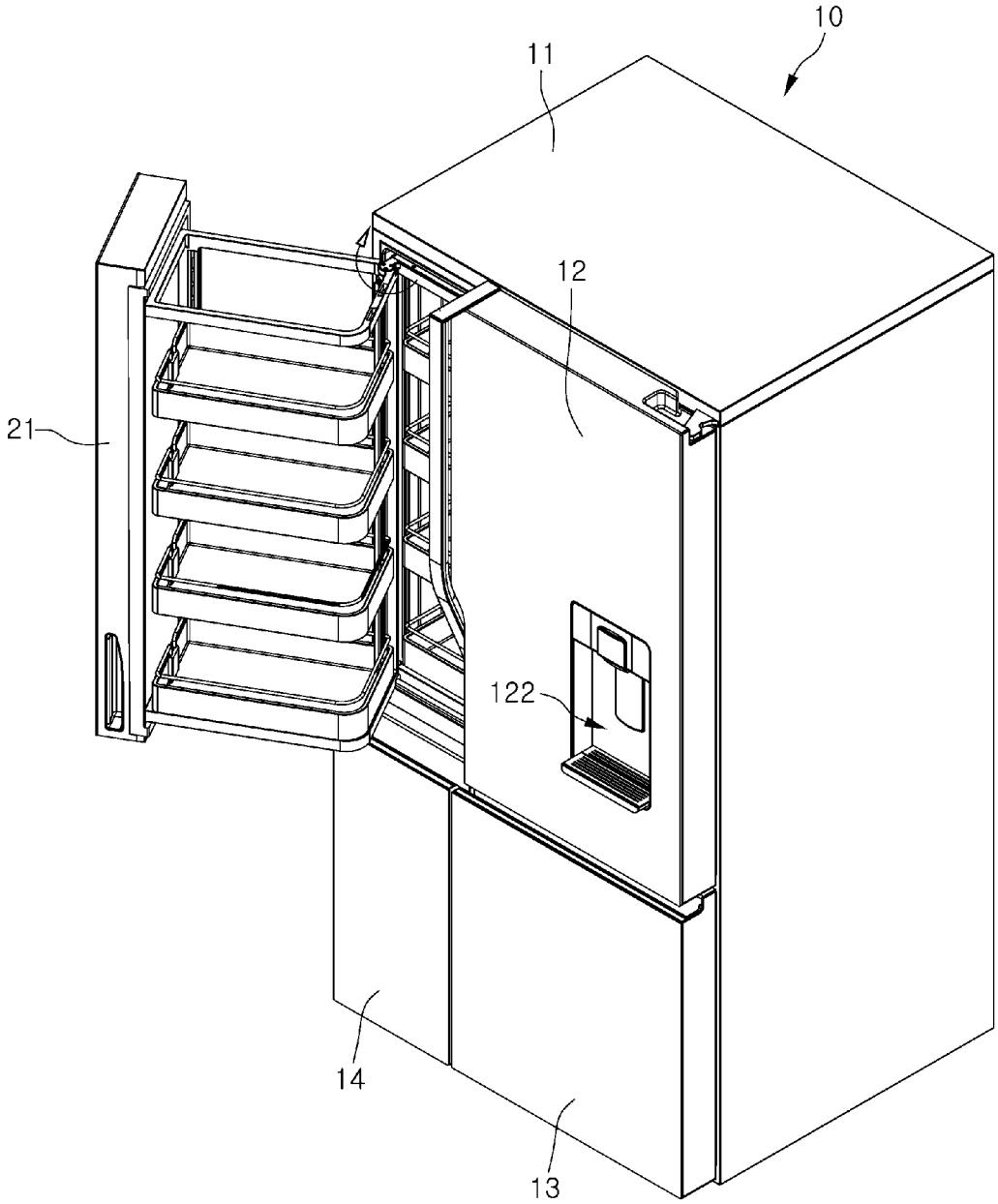
FIG. 5 is a perspective view illustrating a state in which the second pantry part of FIG. 3 has rotated.

FIG. 4 is a perspective view illustrating a state in which a second pantry part constituting a pantry assembly is pulled out of a refrigerator according to an embodiment. FIG. 5 is a perspective view illustrating a state in which the second pantry part of FIG. 3 has rotated.

Referring to FIGS. 4 and 5, the pantry assembly 20 is completely retracted in the refrigerator compartment 111 when the pantry door 21 is completely closed. Thus, the refrigerator 10 is substantially the same in appearance as a typical bottom freezer type refrigerator having a pair of refrigerator doors.

However, the pantry assembly 20 is different from a typical bottom freezer type refrigerator in that the pantry assembly 20 slides out and then rotates.

In detail, the pantry door 21 is pulled forward to pull out the pantry assembly 20.

Then, the pantry assembly 20 is smoothly pulled out by the rail member and the rollers 237. The first pantry part 23 is pulled out up to the front surface of the refrigerator compartment 111. That is, the first pantry part 23 may be pulled out up to a vertical surface disposed on a front opening of the refrigerator compartment 111, or be pulled out just before the vertical surface.

When the first pantry part 23 is maximally pulled out, the second pantry part 22 rotates. In detail, when the pantry door 21 is opened, the second pantry part 22 can rotate up to 90 degrees. While the second pantry part 22 rotates, the damping unit 25 operates such that the second pantry part 22 rotates at a constant speed.

*Accordingly, after opening the refrigerator door, a user can store an object or take out it from the refrigerator compartment 111 without putting a part of his/her body into the refrigerator compartment 111. That is, a user can take an object out from the second pantry part 22 and put an object into the second pantry part 22, without putting his/her hand in the refrigerator compartment 111 or bending his/her body. An object can be taken out from the first pantry part 23 without putting a hand deep into the refrigerator compartment 111, so that the user can conveniently use the refrigerator 10. In detail, when the pantry door 21 is closed, an object is stored deep in the first pantry part 23, and thus, is effectively cooled. When the pantry door 21 is pulled out, the first pantry part 23 moves forward up to the front surface of the refrigerator compartment 111. Thus, a user can more conveniently put an object in the first pantry part 23 or take out an object from the first pantry part 23.

In the case of a typical refrigerator, an object is stored in the rear portion of a refrigerator compartment first to more efficiently store objects. However, according to the embodiment, an object can be stored in the front portion of the basket 224 first since the second pantry part 22 can be rotated 90 degrees outside the refrigerator 10. Moreover, since the first pantry part 23 can be pulled out up to the front surface of the refrigerator compartment 111, an object is more conveniently stored in the rear portion of the basket 234.

The pantry assembly 20 may be provided in plurality to the refrigerator compartment 111. That is, a pantry assembly structure such as the pantry assembly 20 may be provided in a pair within a refrigerator compartment. Furthermore, pantry assembly structures may be provided to both a refrigerator compartment and a freezer compartment. For example, in the case of a side by side type refrigerator that includes a refrigerator compartment and a freezer compartment at both sides, pantry assembly structures may be disposed in the refrigerator compartment and the freezer compartment, respectively.

Figure 6:
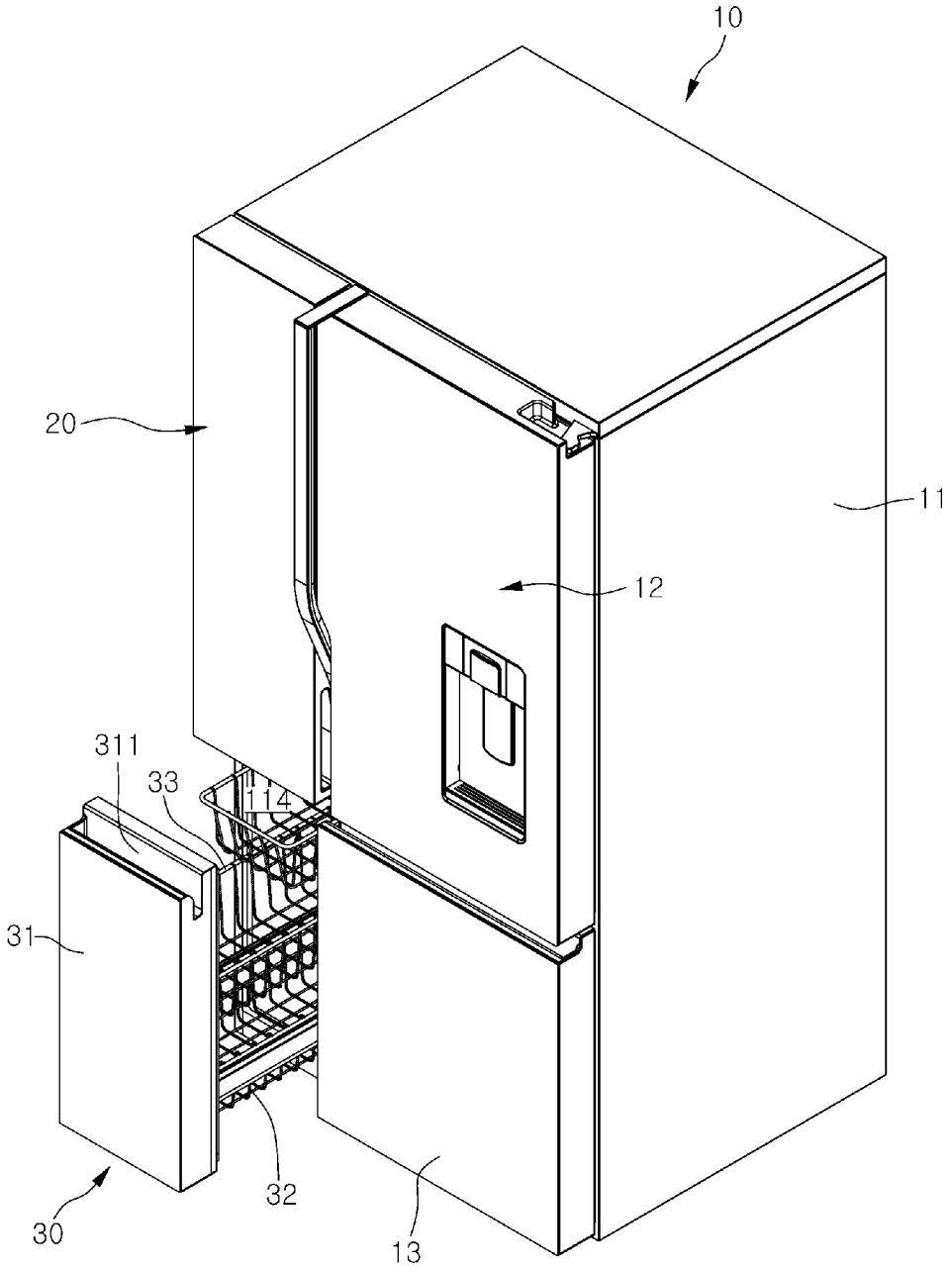
FIG. 6 is a perspective view illustrating a refrigerator when a drawer-type pantry door is opened, according to an embodiment.

FIG. 6 is a perspective view illustrating a refrigerator when a drawer-type pantry door is opened, according to an embodiment.

Referring to FIG. 6, the refrigerator 10 according to an embodiment includes the main body 11 having a storage space therein, and doors selectively opening the storage space.

The doors include the refrigerator door 12 selectively opening a portion of the refrigerator compartment, a pantry door 20 selectively opening the rest of the refrigerator compartment, and the freezer door 13 selectively opening the freezer compartment.

A pantry room 114 may be disposed at a side of the freezer compartment and is separated from the freezer compartment.

In detail, a drawer-type pantry assembly 30 is accommodated in the pantry room 114. The drawer-type pantry assembly 30 can be pulled out from the pantry room 114 or be pushed into the pantry room 114 in a back-and-forth translation motion.

The drawer-type pantry assembly 30 includes a drawer-type pantry door 31, a pantry basket 32 coupled to the rear surface of the drawer-type pantry door 31, and one or more moving baskets 33 disposed in the pantry room 114 and moving back and forth.

In detail, the drawer-type pantry door 31, which stands upright, moves back and forth to selectively open and close the pantry room 114. The pantry basket 32 and the moving baskets 33 may be provided in the form of a wire rack as illustrated in FIG. 6, or in the form of a box having an upper opening.

A handle part 311 may be recessed from the top surface of the drawer-type pantry door 31. The pantry basket 32 moves together with the drawer-type pantry door 31. The moving basket 33 can be pushed in and pulled out, separately from the pantry basket 32. Furthermore, the moving basket 33 may be pulled out together with the drawer-type pantry door 31, and be independently moved back and forth when the drawer-type pantry door 31 has been pulled out.

This structure will now be described.

Figure 7:
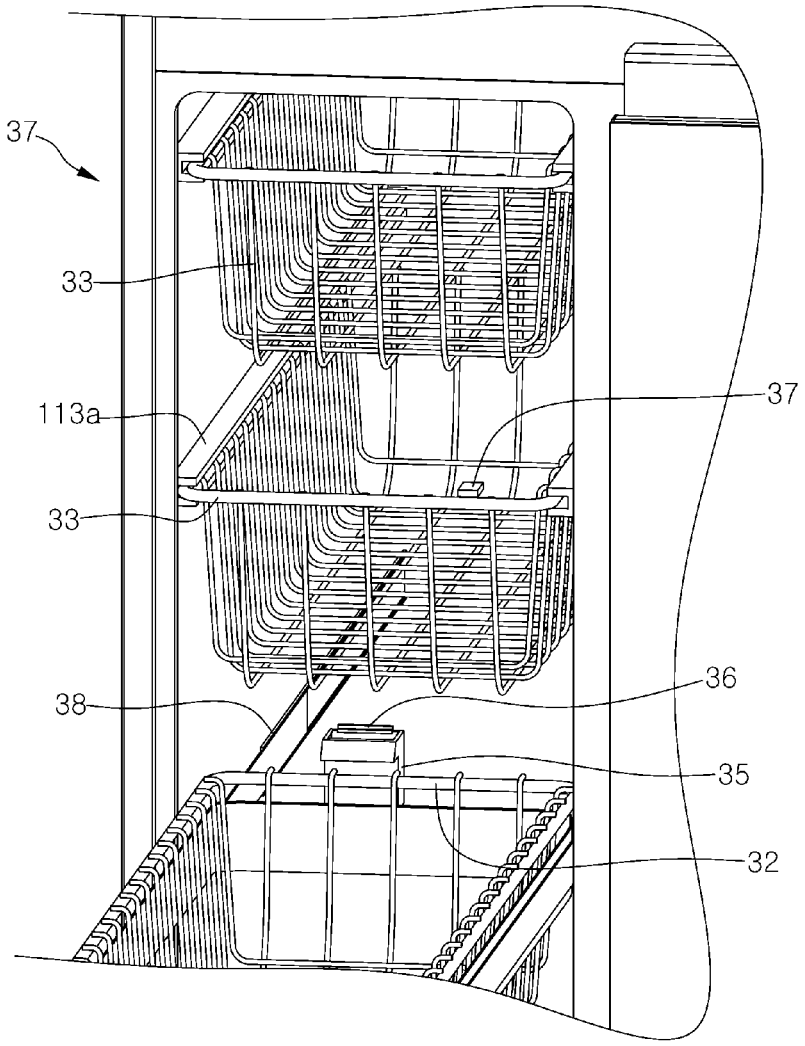
FIG. 7 is a perspective view illustrating an inner structure of a pantry room for a freezer compartment according to an embodiment.

FIG. 7 is a perspective view illustrating an inner structure of a pantry room for a freezer compartment according to an embodiment.

Referring to FIG. 7, one or more of the moving baskets 33 are vertically spaced a constant distance from one another in the pantry room 114. Guide parts 113*a* may be disposed on both side surfaces of the pantry room 114 to guide a back-and-forth movement of the moving baskets 33. The guide parts 113*a* are used to move the moving baskets 33 back and forth in a horizontal state without shaking.

A rail assembly 38 is used to horizontally move the drawer-type pantry door 31 and the pantry basket 32 back and forth. In detail, the rail assembly 38 connects the side surfaces of the pantry basket 32 to the side surfaces of the pantry room 114, and may be a telescopic rail formed in sections which slide into each other. Thus, when the drawer-type pantry door 31 is pulled out, the rail assembly 38 is stretched out, and the pantry basket 32 is drawn out from the pantry room 114.

A drawer mechanism may be disposed on the rear surface of the pantry basket 32 to draw out the moving basket 33 disposed on the vertical upper side of the pantry basket 32.

In detail, the drawer mechanism includes a support 35 extending upward from the rear surface of the pantry basket 32, a hook member 36 rotatably provided to the top surface of the support 35, and a press protrusion 37 protruding from a rear wall of the pantry room 114 and pressing the hook member 36.

In more detail, while the drawer-type pantry door 31 is pulled out, the hook member 36 catches a portion of the bottom of the moving basket 33 to pull out the moving basket 33 together with the drawer-type pantry door 31. Hereinafter, a structure and an operation of the drawer mechanism will now be described.

Figure 8:
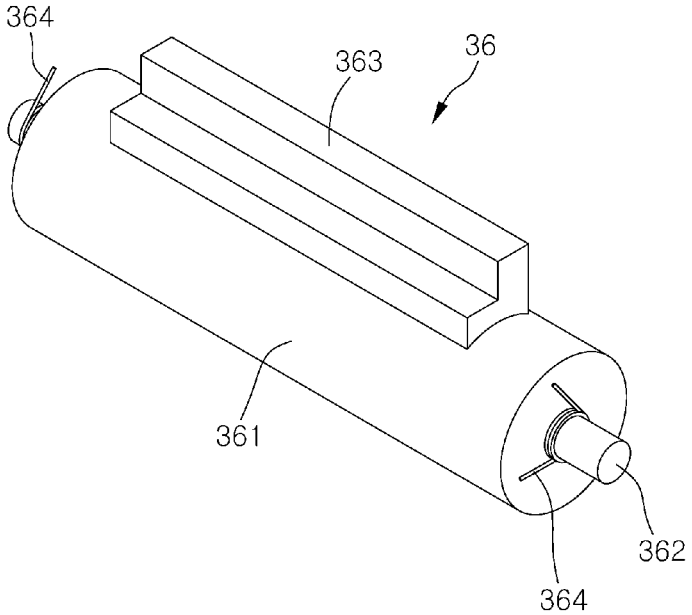
FIG. 8 is a perspective view illustrating a hook member constituting a drawer mechanism according to an embodiment.
Figure 9:
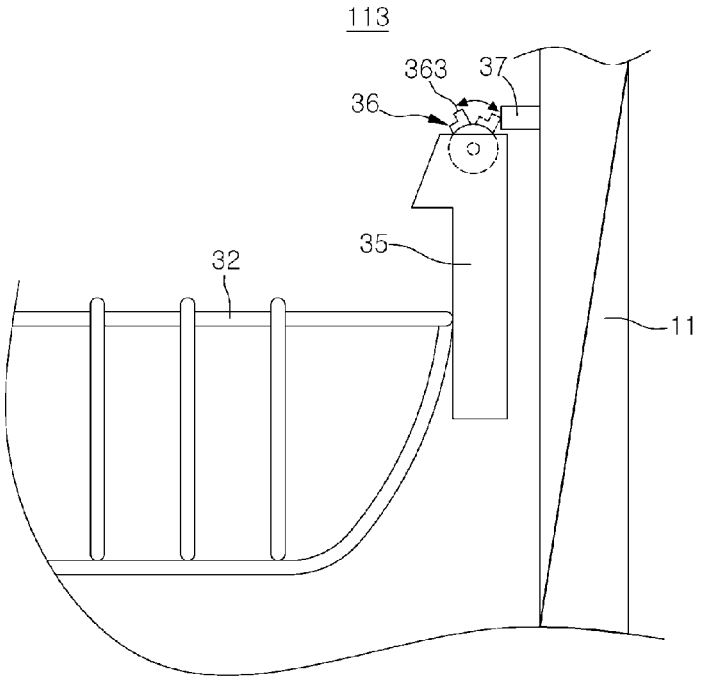
FIG. 9 is a side view illustrating an operation of the hook member of FIG. 8.

FIG. 8 is a perspective view illustrating a hook member constituting a drawer mechanism according to an embodiment. FIG. 9 is a side view illustrating an operation of the hook member of FIG. 8.

Referring to FIG. 8, the hook member 36 includes a body 361 having a cylindrical shape, a hook 363 protruding from a circumferential surface of the body 361, rotation shafts 362 protruding from both ends of the body 361, and elastic members 364 wound around the rotation shafts 362.

In detail, the body 361 may be rotatably coupled to the top surface of the support 35. For example, a portion of the body 361 is embedded in the top surface of the support 35 such that the body 361 can be rotated.

The hook 363 protruding from the circumferential surface of the body 361 catches the bottom of the moving basket 33. The press protrusion 37 presses the hook member 36 to rotate the hook member 36 forward. When the moving basket 33 moves backward, the bottom of the moving basket 33 is caught to the hook member 36, and the hook member 36 rotates rearward.

After the hook member 36 rotates through a predetermined angle, the hook member 36 is rotated to a hooking angle or a releasing angle by elastic force (or resilient force) of the elastic members 364. The hooking angle is an angle where the hook member 36 finally hooks a hanger 333 of the moving basket 33. The releasing angle is an angle where the hook member 36 is finally released from the hanger 333. In other words, the hooking angle may be a maximum forward rotation angle of the hook member 36, and the releasing angle may be a maximum rearward rotation angle of the hook member 36.

Figure 10:
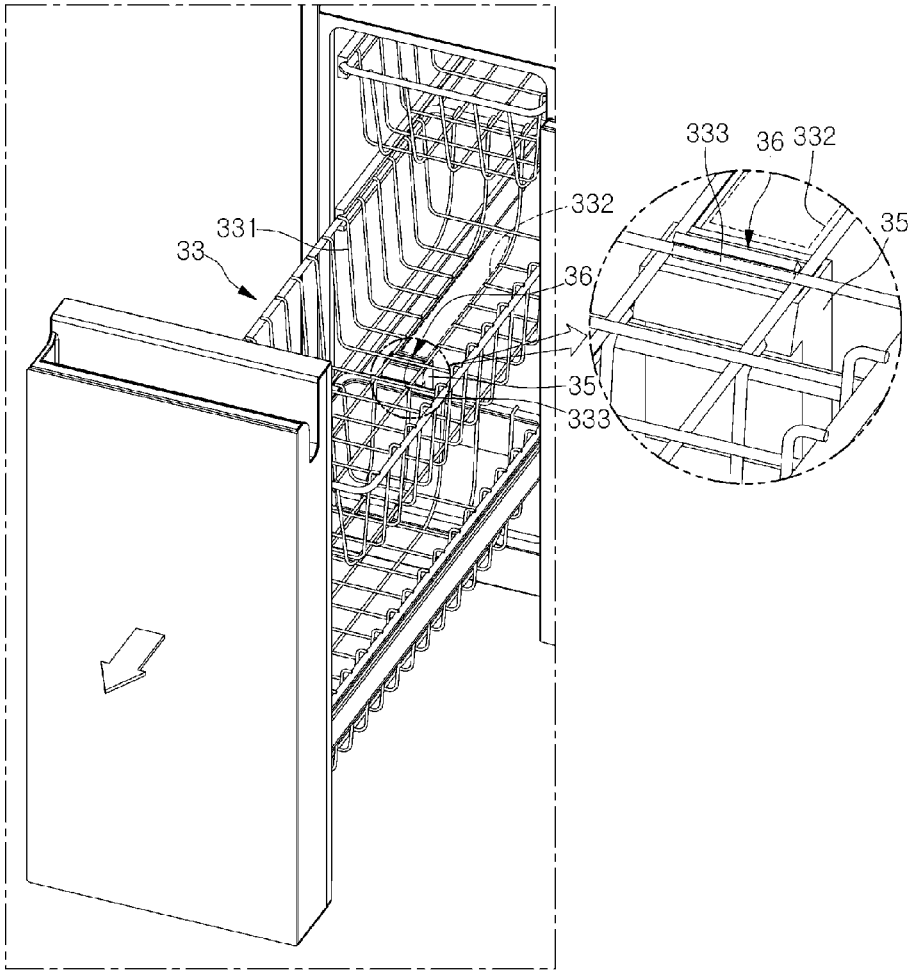
FIG. 10 is a perspective view illustrating a moving basket pulled out together with a drawer-type pantry door moving forward, according to an embodiment.

FIG. 10 is a perspective view illustrating a moving basket pulled out together with a drawer-type pantry door moving forward, according to an embodiment.

Referring to FIG. 10, an opening 332 may extend a predetermined length in the bottom of the moving basket 33 disposed on the vertical upper side of the pantry basket 32 not to interfere with the hook member 36. The hanger 333 that is hooked by the hook member 36 is disposed at the front end of the opening 332.

In detail, since the moving basket 33 has a wire rack structure in the current embodiment, a wire constituting the bottom of the moving basket 33 and disposed at the front end of the opening 332 functions as the hanger 333. Since there is no wire in the opening 332, the moving basket 33 is not moved while the hook member 36 is disposed in the opening 332. That is, when the drawer-type pantry door 31 moves forward, while the hook member 36 is disposed within the opening 332, the moving basket 33 does not move.

Alternatively, the moving basket 33 may have a box shape including plates and an upper opening having no plate. Also in this case, the opening 332 may be disposed in the bottom surface of the moving basket 33, but the front side of the opening 332, not a wire, is hooked by the hook member 36. The opening 332 extends a predetermined length forward from the rear end of the bottom surface of the moving basket 33. A time when the pulling of the moving basket 33 starts is determined according to a length of the opening 332. For example, as the length of the opening 332 decreases, an interval between a time when the drawer-type pantry door 31 starts to move forward and a time when the moving basket 33 start to move forward decreases.

A length that the moving basket 33 is pulled out is determined according to the length of the opening 332, that is, according to a position of the hanger 333 of the opening 332. In other words, when the opening 332 is long, that is, the hanger 333 of the opening 332 is close to the front surface of the moving basket 33, the length that the moving basket 33 is pulled out decreases. On the contrary, when the opening 332 is short, the length that the moving basket 33 is pulled out increases.

When the front end of the opening 332, that is, the hanger 333 is hooked by the hook member 36, the moving basket 33 is pulled out together with the pantry basket 32. Thus, when the hanger 333 is disposed at the rear end of the moving basket 33, the moving basket 33 and the drawer-type pantry door 31 move substantially at the same time. When the hanger 333 is spaced forward from the rear end of the moving basket 33, the drawer-type pantry door 31 is pulled out a predetermined distance, and then, the moving basket 33 is moved forward.

Figure 11:
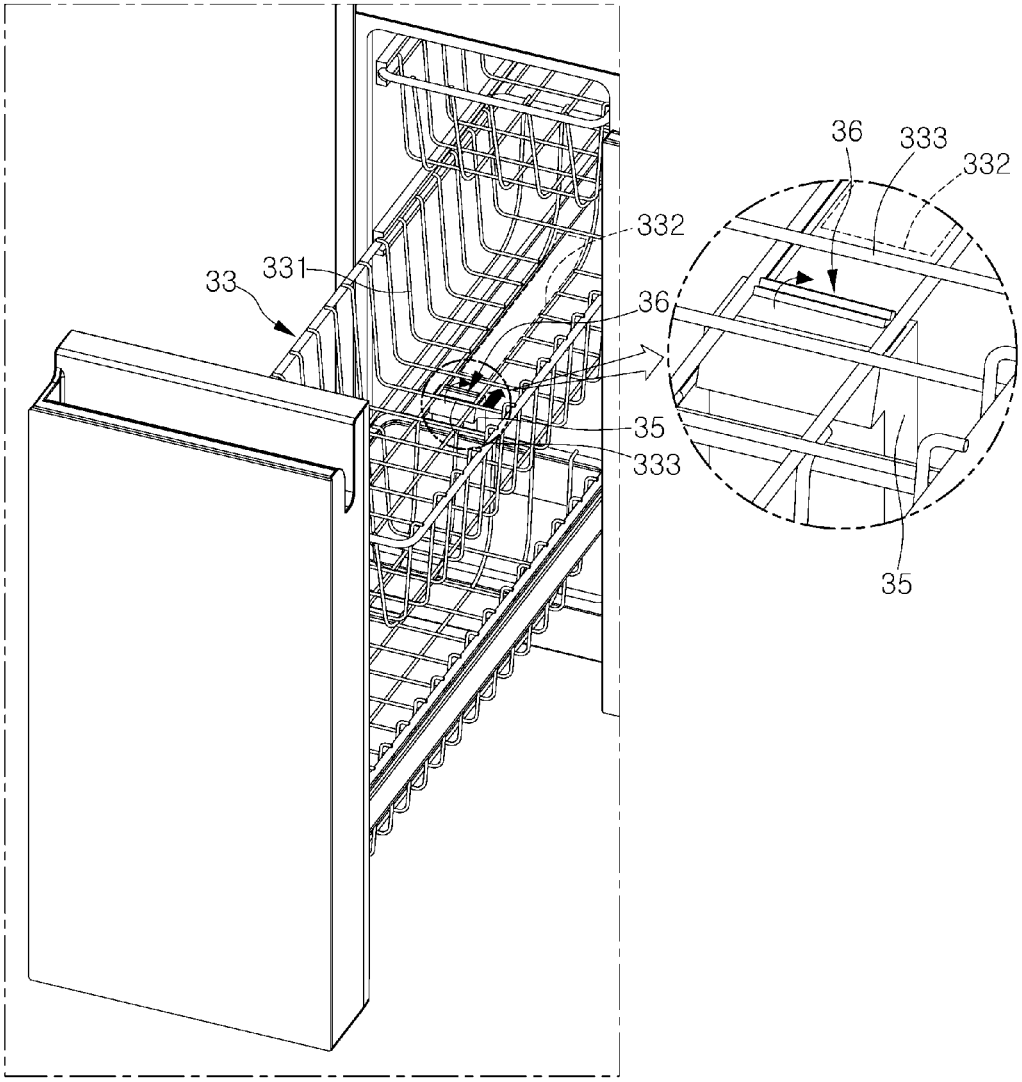
FIG. 11 is a perspective view illustrating a hook member and a moving basket when a drawer-type pantry door moves backward, according to an embodiment.

FIG. 11 is a perspective view illustrating a hook member and a moving basket when a drawer-type pantry door moves backward, according to an embodiment.

Referring to FIG. 11, after an object is put in or taken out from a storage space of a pantry for a refrigerator compartment, the drawer-type pantry door 31 is closed.

First, it is assumed that the hook member 36 has been rotated forward, and the moving basket 33 has been pulled out. That is, it is assumed that the moving basket 33 has been pulled out, and is not pushed in yet.

In this state, the drawer-type pantry door 31 and the moving basket 33 are moved backward simultaneously or sequentially. In other words, only the drawer-type pantry door 31 and the pantry basket 32 move backward until the rear surface of the drawer-type pantry door 31 contacts the moving basket 33. After the rear surface of the drawer-type pantry door 31 contacts the front surface of the moving basket 33, the pantry basket 32 and the moving basket 33 move backward together. Thus, a time when the moving basket 33 starts to move backward is determined according to a length through which the moving basket 33 is pulled out.

When only the drawer-type pantry door 31 is pulled out with the moving basket 33 fixed, the hook member 36 is rotated backward by pressing of the hanger 333. Then, the hanger 333 is released from the hook member 36. Then, when the hook member 36 rotates rearward, the bottom of the moving basket 33 does not interfere with the hook member 36. On the contrary, the drawer-type pantry door 31 and the moving basket 33 may be pulled out a predetermined length, and then, the moving basket 33 may be pushed rearward with the drawer-type pantry door 31 fixed. Also in this case, the hook member 36 rotates rearward.

The moving basket 33 may be pulled out after the drawer-type pantry door 31 is pulled out. In this case, a user may pull out the drawer-type pantry door 31 through a predetermined distance, and then, determine whether to move the moving basket 33 and the drawer-type pantry door 31 simultaneously. In other words, when a user does not want to pull out the moving basket 33, the following operation may be performed. First, a user pulls out the drawer-type pantry door 31 through a predetermined distance. At this point, if the moving basket 33 is also pulled out through a predetermined distance, the moving basket 33 is pushed rearward. If the moving basket 33 is not pulled out yet, the drawer-type pantry door 31 is further pulled out with the moving basket 33 held. Then, the hook member 36 is rotated rearward by pressing of the hanger 333, and is released from the hanger 333. After that, when the drawer-type pantry door 31 is pulled out, only the pantry basket 32 is pulled out with the moving basket 33 fixed.

When the drawer-type pantry door 31 is closed with the hook member 36 rotated rearward, the following operation is performed.

In detail, just before the drawer-type pantry door 31 is completely closed, the press protrusion 37 pushes the moving basket 33 forward (refer to the description with FIG. 4). Then, when the drawer-type pantry door 31 is completely closed, the hook member 36 rotates forward and is ready to couple to the hanger 333 of the moving basket 33. The hook member 36 rotated through a predetermined angle by the press protrusion 37 is automatically rotated to the hooking angle by the resilient force of the elastic members 364 installed on the hook member 36.

Accordingly, the pantry basket 32 and the moving basket 33 may be pulled out together, or only the pantry basket 32 may be pulled out, according to a user's selection.

A refrigerator according to various other embodiments may be described.

Hereinafter, a refrigerator will now be described with reference to the accompanying drawings according to another embodiment. According to the current embodiment, a pantry assembly, which can be pulled out, is disposed in a storage space, and a rotatable door covers the pantry assembly pushed in the storage space.

Figure 12:
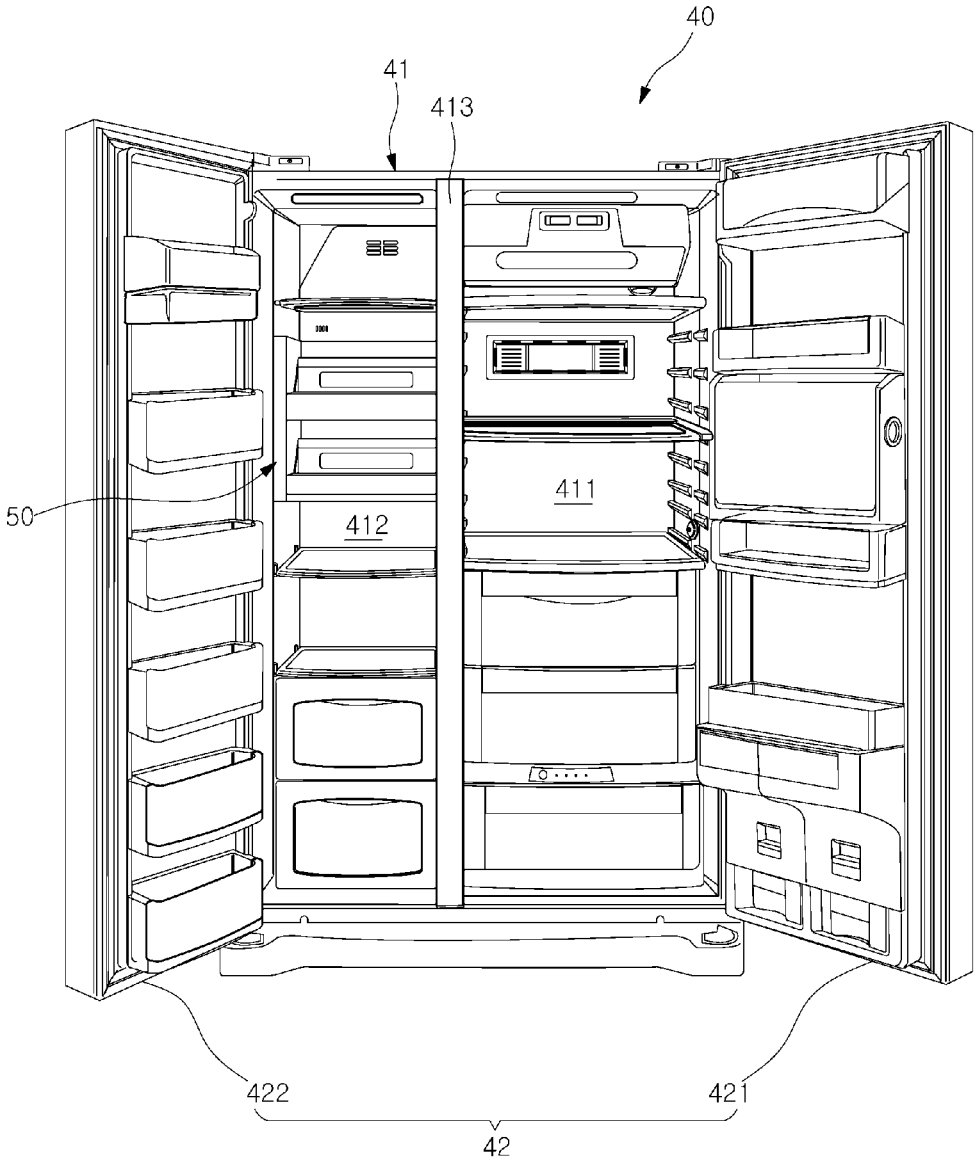
FIG. 12 is a perspective view illustrating an inner structure of a refrigerator according to an embodiment.

FIG. 12 is a perspective view illustrating an inner structure of a refrigerator according to an embodiment.

Referring to FIG. 12, a refrigerator 40 according to an embodiment includes a main body 41 having a storage space therein, and doors 42 opening/closing the storage space. The main body 41 and the doors 42 form an appearance of the refrigerator 40. The storage space of the main body 41 is divided into left and right portions by a barrier 413, and the left and right portions form a refrigerator compartment 412 and a freezer compartment 411, respectively. The doors 42 may include a refrigerator door 421 and a freezer door 422, which open and close the refrigerator compartment 411 and the freezer compartment 412, respectively.

*The refrigerator door 421 and the freezer door 422 may be rotatably installed on the main body 41, and rotate to the right and left side, respectively, to independently open and close the refrigerator compartment 411 and the freezer compartment door 412.

Storage members such as a shelf and a drawer may be disposed inside the refrigerator compartment 411 and the freezer compartment 412. Various foods can be appropriately stored in each space separated by the storage members.

A pantry assembly 50 may be disposed in the freezer compartment 412. The pantry assembly 50 can be pushed in and pulled out from the freezer compartment 412. At least one portion of the pantry assembly 50 may be pulled out, and then, the pantry assembly 50 may rotate to facilitate the storing of food.

Although the pantry assembly 50 is disposed in the freezer compartment 412 in the current embodiment, the pantry assembly 50 may be disposed in any compartment having a front opening in the refrigerator, such as the refrigerator compartment 411. The pantry assembly 50 may be disposed in a space having a size corresponding to the pantry assembly 50, and be covered with a door having a size corresponding to the pantry assembly 50.

Hereinafter, the pantry assembly 50 will now be described in more detail.

Figure 13:
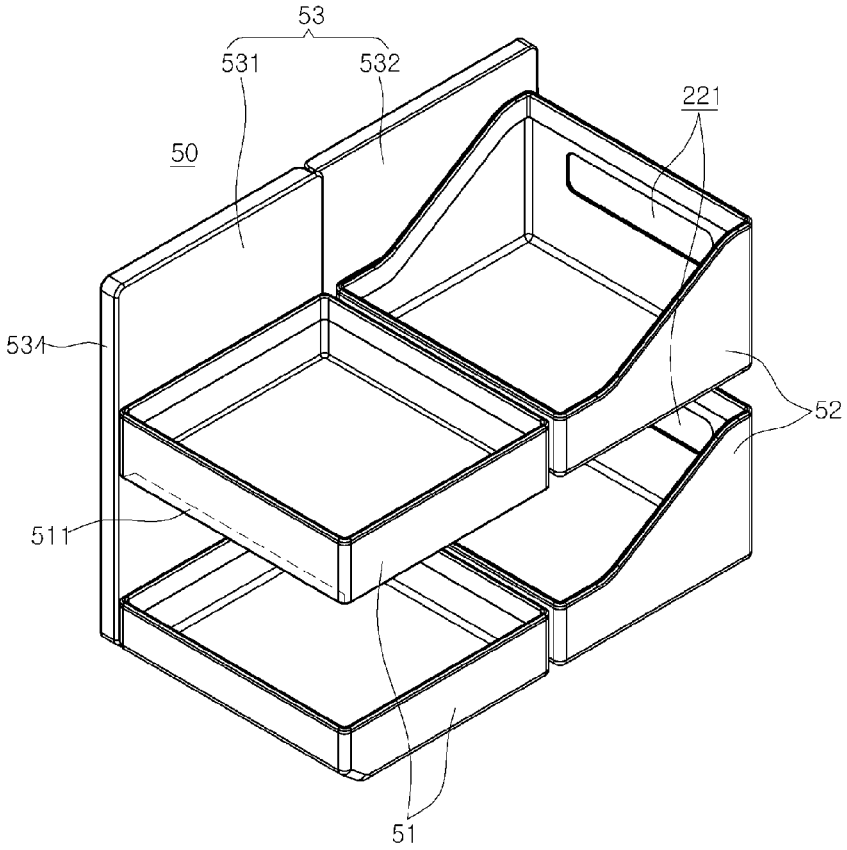
FIG. 13 is a perspective view illustrating a pantry assembly according to an embodiment.
Figure 14:
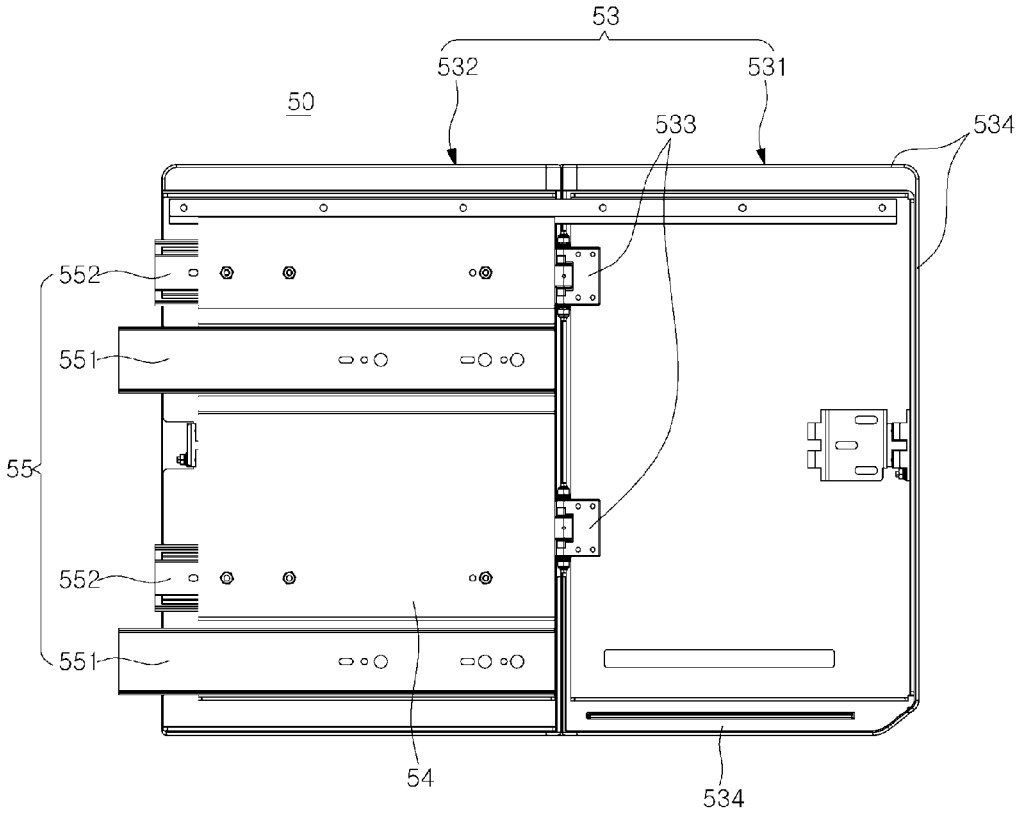
FIG. 14 is a side view illustrating the pantry assembly of FIG. 13.
Figure 15:
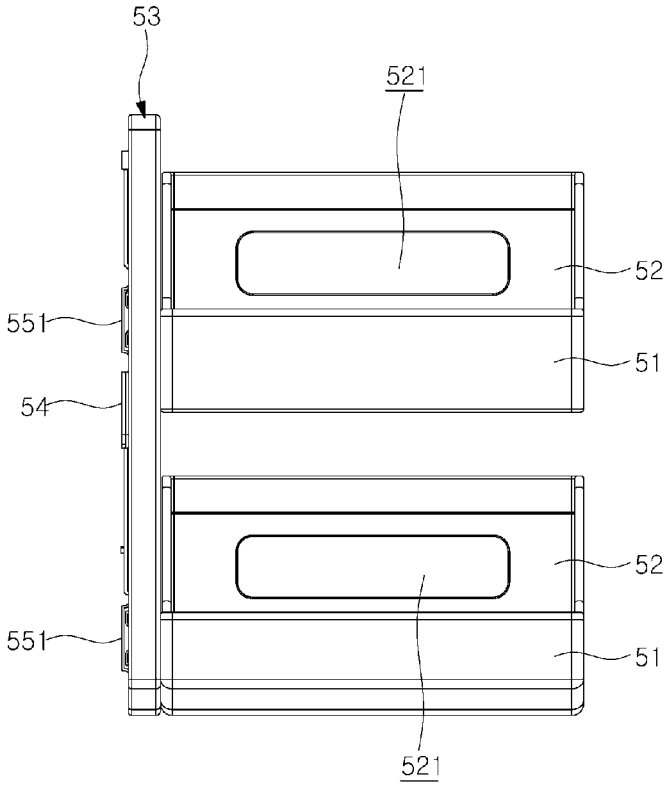
FIG. 15 is a front view illustrating the pantry assembly of FIG. 13.
Figure 16:
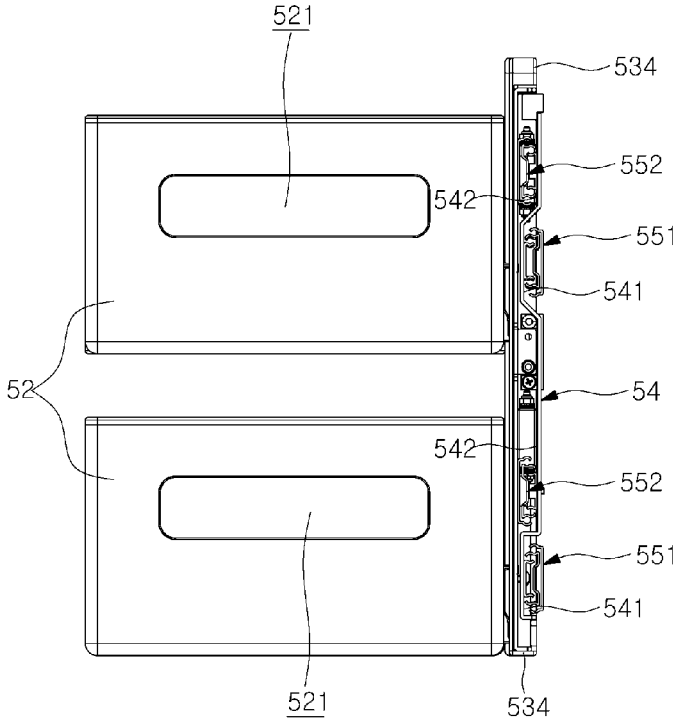
FIG. 16 is a rear view illustrating the pantry assembly of FIG. 13.

FIG. 13 is a perspective view illustrating a pantry assembly according to an embodiment. FIG. 14 is a side view illustrating the pantry assembly of FIG. 13. FIG. 15 is a front view illustrating the pantry assembly of FIG. 13. FIG. 16 is a rear view illustrating the pantry assembly of FIG. 13.

Referring to FIGS. 13 to 16, the pantry assembly 50 may include a first pantry part 52 for storing a food, a second pantry part 51 for storing a food, an installation member 53 on which the first pantry part 52 and the second pantry part 51 are installed, and rail members 55 configured such that the installation member 53 can be pushed in and pulled out form the freezer compartment 412.

In detail, the second pantry part 51 is disposed on the front portion of the installation member 53 at a position to rotate after the pantry assembly 50 is pulled out. That is, the second pantry part 51 may be installed on a second installation part 531 that constitutes the installation member 53 and is rotatable.

The second pantry part 51 has basket shapes that are open upward. At least one portion of the second pantry part 51 is transparent to easily perceive a food therein. The second pantry part 51 is flush with the front end of the installation member 53. Thus, when the freezer door 422 is opened, access to the second pantry part 51 is facilitated.

The second pantry part 51 may be provided in plurality on the upper and lower sides, and each of the second pantry parts 51 may be fixed to the installation member 53 through a side surface thereof (the left side surface in FIG. 13). At least one of the second pantry parts 51 may include a handle 511 at the front lower end thereof, so that a user can hold the handle 511. The handle 511 may be recessed upward, so that a user can conveniently hold the handle 511.

The first pantry parts 52 are disposed behind the second pantry parts 51. The first pantry part 52 has a basket shape that is open upward. At least one portion of the first pantry part 52 is transparent to easily perceive a food therein.

The first pantry part 52 and the second pantry part 51 may be disposed on the same line. The first pantry part 52 may be disposed on the rear portion of the installation member 53, that is, on a first installation part 532. The first pantry part 52 is fixed to the first installation part 532 through a side surface thereof (the left side surface in FIG. 13), and may have the same width as that of the second pantry part 51. When the second pantry part 51 is not rotated, the front surface of the first pantry part 52 may contact the rear surface of the second pantry part 51. The front surface of the first pantry part 52 and the rear surface of the second pantry part 51 may have the same size and the same shape to provide the sense of unity when the front surface of the first pantry part 52 contacts the rear surface of the second pantry part 51.

The rear surface of the first pantry part 52 may have a greater height than that of the front surface thereof to prevent a drop of a food during the pushing and pulling of the pantry assembly 50. A cooling hole 521 may be disposed in the rear surface of the first pantry part 52. Cool air supplied from a cooling duct outlet (not shown) disposed in the rear surface of the refrigerator compartment 411 more efficiently flows to the first pantry part 52 and the second pantry part 51 through the cooling hole 521. The left and right surfaces of the first pantry part 52 may be inclined to increase in height from the front side to the rear side.

Each of the first pantry part 52 and the second pantry part 51 is fixed to the installation member 53 only through the side surface thereof (the left side in FIG. 13), and the opposite surface to the fixed side surface may be adjacent to the barrier 413. Thus, when the pantry assembly 50 is completely inserted in the freezer compartment 412, the pantry assembly 50 may look like the pantry assembly 50 contacts the left and right walls of the refrigerator compartment 411.

The installation member 53, on which the first pantry parts 52 and the second pantry parts 51 are installed, may have a plate shape, and can be pushed in and pulled out together with the first pantry parts 52 and the second pantry parts 51.

The installation member 53 may include the first installation part 532 on which the first pantry parts 52 are installed, and the second installation part 531 on which the second pantry parts 51 are installed. The first installation part 532 and the second installation part 531 may have separate plate shapes, respectively, and may be rotatably connected to each other through a connecting member 533.

The connecting member 533 may be provided in the form of a hinge, and is connected to the first installation part 532 and the second installation part 531 therebetween. The connecting member 533 may be provided in plurality, which is rotatably connected to the first installation part 532 and the second installation part 531.

The connecting members 533 may be configured such that, when the first installation part 532 is fixed, the second installation part 531 can rotate clockwise about the front end of the first installation part 532. The second installation part 531 and the freezer door 422 rotate in the same direction. After the freezer door 422 is opened, even when the second installation part 531 rotates, the second installation part 531 does not interfere with the freezer door 422.

When the pantry assembly 50 is disposed in the refrigerator compartment 411, the second installation part 531 and the refrigerator door 421 rotate in the same direction. That is, the second installation part 531 and a door closing a space including the pantry assembly 50 may rotate in the same direction.

A sub plate 54 may be spaced apart from the first installation part 532. The installation member 53 can be stably pulled out by the sub plate 54, and the second installation part 531 can be pulled completely out of the refrigerator by the sub plate 54. The sub plate 54 is disposed between the first installation part 532 and an inner wall of the freezer compartment 412, and is coupled to the first installation part 532 and the inner wall of the freezer compartment 412 through the rail members 55.

The sub plate 54 includes first recesses 541 and second recesses 542. A first rails 551 may be installed on the first recesses 541, and second rails 552 may be installed on the second recesses 542. The sub plate 54 may be accommodated in a recessed side surface of the installation member 53. Thus, the sub plate 54 and the rail members 55 may be disposed in a minimum space between the installation member 53 and the inner wall of the freezer compartment 412. A protrusion part 534 is disposed around the installation member 53 except for the rear end thereof. The protrusion part 534 extends toward the inner wall of the freezer compartment 412. The sub plate 54 and the rail members 55 may be hidden by the protrusion part 534 disposed at the front, upper, and lower ends of the installation member 53.

The rail member 55 for sliding the installation member 53 back and forth may be provided in plurality, and include a telescopic rail formed in sections which slide into each other, and can be pulled out through a sufficient distance to prevent interference during the rotating of the second pantry parts 51.

In detail, the rail members 55 may include the first rails 551 and the second rails 552. The first rails 551 are disposed between the inner wall of the freezer compartment 412 and the sub plate 54 such that the sub plate 54 can slide in and out of the freezer compartment 412. The first rail 551 is provided in a pair at the upper and lower sides to stably slide the sub plate 54.

The second rails 552 are disposed between the first installation part 532 and the sub plate 54 such that the first installation part 532 can slide to the front side of the sub plate 54. The second rail 552 is provided in a pair at the upper and lower sides to stably slide the first installation part 532.

The first rails 551 and the second rails 552 have lengths to pull the second installation part 531 completely out of the freezer compartment 412. At this point, the front end of the first installation part 532 may be flush with the front end of the freezer compartment 412, or further protrude than the front end of the freezer compartment 412, so as to prevent interference between the second installation part 531 and the main body 41 during the rotation of the second installation part 531.

The first rails 551 and the second rails 552 may be alternately arrayed from a side view, and are used to stably slide the sub plate 54 and the installation member 53.

Hereinafter, an operation of the pantry assembly 50 will now be described.

Figure 17:
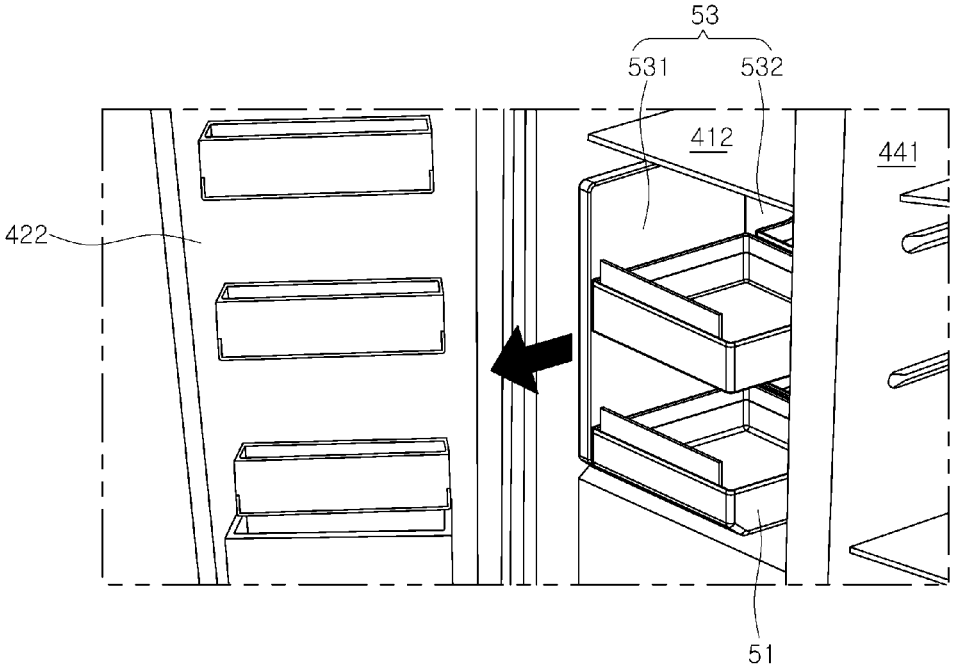
FIG. 17 is a perspective view illustrating a state in which a refrigerator door is opened, and a pantry assembly is completely pushed in, according to an embodiment.
Figure 18:
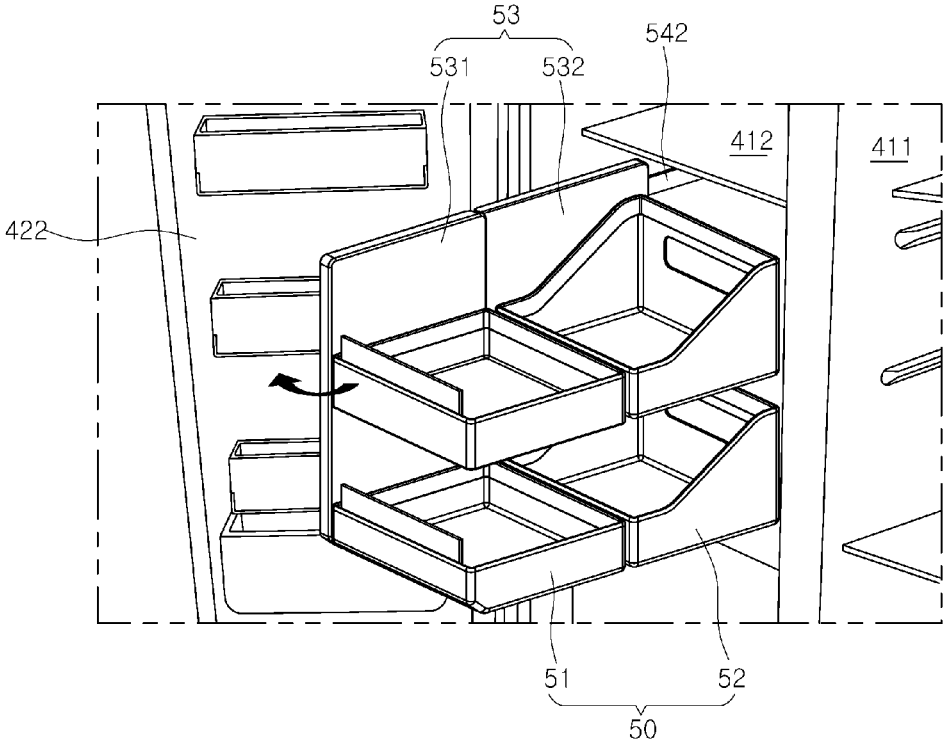
FIG. 18 is a perspective view illustrating a state in which the pantry assembly of FIG. 17 is completely pulled out.
Figure 19:
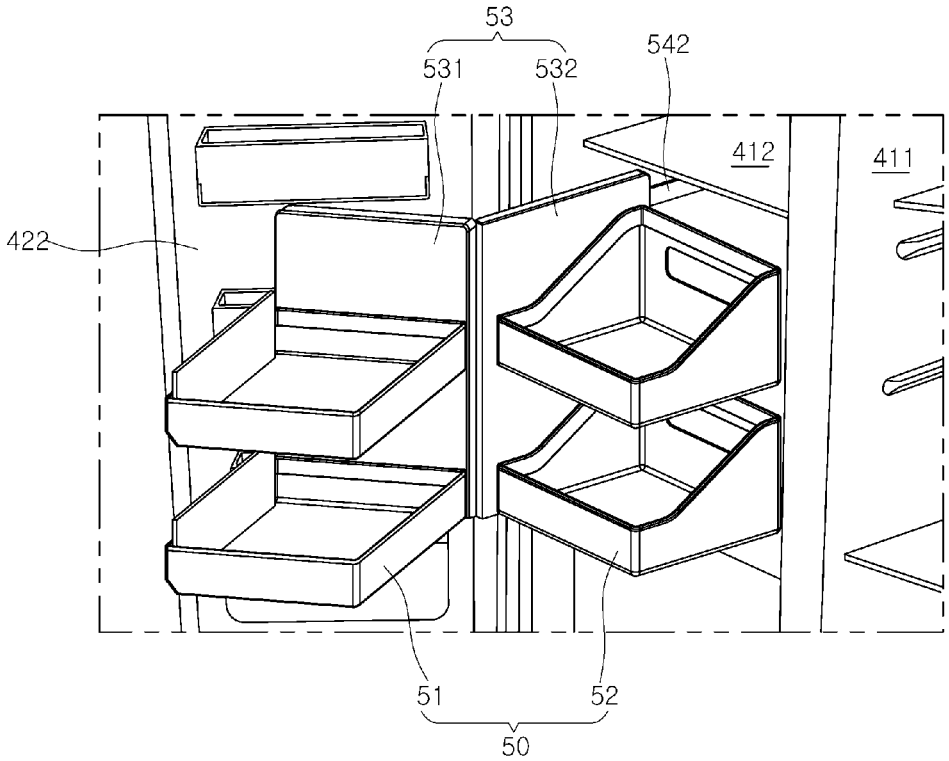
FIG. 19 is a perspective view illustrating a second pantry part rotated according to an embodiment.

FIG. 17 is a perspective view illustrating a state in which a refrigerator door is opened, and a pantry assembly is completely pushed in, according to an embodiment. FIG. 18 is a perspective view illustrating a state in which the pantry assembly of FIG. 17 is completely pulled out. FIG. 19 is a perspective view illustrating a second pantry part rotated according to an embodiment.

Referring to FIG. 17, the pantry assembly 50 is inserted completely in the freezer compartment 412 before being pulled out. In this state, a user can approach the second pantry part 51 to store a food therein.

To pull out the pantry assembly 50, the freezer door 422 is opened first. At this point, the pantry assembly 50 is completely inserted in the freezer compartment 412 as illustrated in FIG. 17.

In this state, the user holds the handle 511 formed in the second pantry part 51 exposed forward, and pulls out the handle 511. At this point, the rail members 55 are stretched out, and the installation member 53 slides forward. Accordingly, the first pantry part 52 and the second pantry part 51 move forward.

At this point, the first rails 551 are stretched out first to move the sub plate 54 forward. When the first rails 551 are completely stretched out, the second rails 552 are stretched out to move the first installation part 532 forward. Alternatively, the second rails 552 may be stretched out first, or the first rails 551 and the second rails 552 may be stretched out at the same time.

Referring to FIG. 18, the handle 511 is pulled out until the second pantry part 51 is maximally pulled out. In this state, the first rails 551 and the second rails 552 are completely stretched out.

At this point, the rear end of the second pantry part 51 is disposed at the front side of the front surface of the freezer compartment 412 to prevent interference between the second pantry part 51 and the main body 41 during the rotation of the second pantry part 51.

When the second pantry part 51 is completely pulled out, the user may hold and rotate the second pantry part 51 as illustrated in FIG. 19. In this state, there is no interference between the second pantry part 51 and the main body 41, and the second pantry part 51 can rotate clockwise (in FIG. 19) by the connecting members 533, that is, both the second pantry part 51 and the freezer door 422 can rotate in the same direction.

The connecting members 533 are configured such that the second pantry part 51 rotates within a predetermined angle not to interfere with the freezer door 422. When the second pantry part 51 rotates, the first pantry part 52 is exposed through the front opening of the freezer compartment 412, so that access to the first pantry part 52 is facilitated. Referring to FIG. 19, when the second pantry part 51 has been rotated, a food can be conveniently stored in the first pantry part 52.

After being completely pulled out and rotated, the pantry assembly 50 may be pushed into the freezer compartment 412 in the opposite sequence to the above-described sequence, and the freezer door 422 may be closed to end the using of the pantry assembly 50.

According to the embodiment, a user can store an object or take out it from the freezer compartment 412 without putting a part of his/her body into the freezer compartment 412. That is, a user can take an object out from the second pantry part 51 and put an object into the second pantry part 51, without putting his/her hand in the freezer compartment 412 or bending his/her body.

An object can be taken out from the first pantry part 52 without putting a hand deep into the freezer compartment 412, so that the user can conveniently use the first pantry part 52. In detail, when the pantry assembly 50 is pushed in, an object accommodated in the first pantry part 52 is stored deep in the freezer compartment 412, and thus, is effectively cooled. On the contrary, when the second pantry part 51 is pulled out, the first pantry part 52 moves forward up to the front surface of the freezer compartment 412. When the second pantry part 51 rotates, a user can more conveniently put an object in the first pantry part 52 or take out an object from the first pantry part 52.

In the case of a typical refrigerator, an object is stored in the rear portion of a freezer compartment first to more efficiently store objects. However, an object can be stored in the front portion of the pantry assembly 50 first without affecting access to the first pantry part 52 since the second pantry part 51 can be rotated 90 degrees outside the refrigerator. Moreover, since the first pantry part 52 can be pulled out up to the front surface of the freezer compartment 412, an object is more conveniently stored in the rear portion of the first pantry part 52.

A single pantry assembly is provided according to the above embodiment, but the present invention is not limited thereto. In other words, a plurality of pantry assembly structures such as the pantry assembly may be disposed at the upper and lower sides in a freezer compartment. Furthermore, the pantry assembly structures may be provided to a refrigerator compartment and a freezer compartment, respectively. In addition, the pantry assembly provided to the refrigerator compartment may have the same structure as that of the pantry assembly 50. In addition, a bottom freezer type refrigerator having a pair of doors for opening a refrigerator compartment may include a pair of pantry assemblies on a side or both sides in the refrigerator compartment.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Industrial Applicability

According to the embodiments, since the pantry assembly can be pushed in, pulled out, and rotated, foods can be efficiently stored, and the refrigerator can be used more conveniently.

The invention claimed is:

1. A refrigerator, comprising:

a main body that defines a first area and a second area side by side and that has an opened front surface that enables access to the first area and the second area;

a pantry assembly configured to horizontally slide in a front-to-rear direction of the main body between a withdrawn position in which the pantry assembly is at least partially withdrawn from the main body and a received position in which the pantry assembly is received in the main body, the pantry assembly being configured to selectively open or close a portion of the opened front surface of the main body corresponding to the first area; and a refrigerator door rotatably connected to a side edge of a front part of the main body and configured to selectively open or close a portion of the opened front surface of the main body corresponding to the second area, wherein the pantry assembly includes:

a first pantry part slidably coupled to the main body and configured to be received in the main body in the received position and at least partially withdrawn from the main body in the withdrawn position;

a second pantry part rotatably coupled to the first pantry part with respect to a vertical axis, a side edge of a rear part of the second pantry part being rotatably coupled to a side edge of a front part of the first pantry part by a hinge part; and a pantry door coupled to a front surface of the second pantry part, wherein, based on the pantry door being oriented in a closed position, a rear surface of the pantry door is in contact with a front edge of the main body, wherein, based on the pantry door being oriented in an opened position, the pantry door is only connected to the main body through the first pantry part.

2. The refrigerator of claim 1, wherein the main body includes a single storage space therein, and wherein the pantry door and the refrigerator door are configured to partially open or close the single storage space, respectively.

3. The refrigerator of claim 2, wherein the single storage space is a refrigerating compartment which is maintained at a refrigerating temperature higher than a freezing temperature.

4. The refrigerator of claim 3, wherein the main body further comprises a freezing compartment that is placed below the refrigerating compartment and that is maintained at the freezing temperature less than the refrigerating temperature.

5. The refrigerator of claim 1, further comprising a rail part that is disposed on at least one of a top surface, a bottom surface, and side surfaces of the first pantry part.

6. The refrigerator of claim 5, further comprising at least one roller disposed on the bottom surface of the first pantry part.

7. The refrigerator of claim 1, further comprising a damping unit that connects bottoms of the first and the second pantry parts, in order to decelerate a rotation speed of the pantry door, wherein the damping unit includes:

a support arm of which one end is installed on a bottom of one of the first and the second pantry parts; and a damper of which one end is installed on a bottom of the other one of the first and the second pantry parts.

8. The refrigerator of claim 1, further comprising a handle recess recessed in a side surface of the first pantry door.

9. The refrigerator of claim 8, further comprising a lever disposed in the handle recess to facilitate a separation of the rear surface of the pantry door from the main body.

10. The refrigerator of claim 1, wherein the hinge part is configured to connect upper surfaces of the first and the second pantry parts.

11. The refrigerator of claim 1, wherein the second pantry part includes:

a lower plate horizontally extending from a lower end of the rear surface of the pantry door;

a plurality of frames coupled to the rear surface of the pantry door; and a plurality of baskets provided at the rear surface of the pantry door and vertically spaced from each other, wherein the plurality of frames includes:

an upper frame extending horizontally from an upper end of the rear surface of the pantry door; and one or more edge frames connecting the upper frame and the lower plate.

12. The refrigerator of claim 1, wherein the first pantry part includes:

a lower plate extending horizontally and defining a bottom of the first pantry part;

an upper plate extending horizontally and defining an upper end of the first pantry part; and one or more edge frames connecting corners of the lower plate and the upper frame.

* * * * *